US005437174A

United States Patent [19]

Aydin

[11] Patent Number: 5,437,174

[45] Date of Patent: Aug. 1, 1995

[54] RETROFITTABLE ELECTRONIC AND MECHANICAL DOOR LOCK SYSTEM

[75] Inventor: Kemal Aydin, 137 Power House Rd. - Apt. 3W, Roslyn, N.Y. 11577

[73] Assignees: David Sokol; Kemal Aydin, both of New York, N.Y. ; a part interest

[21] Appl. No.: 977,561

[22] Filed: Nov. 17, 1992

[51] Int. Cl.[6] ..... E05B 47/06

[52] U.S. Cl. ..... 70/278; 70/280; 70/DIG. 62; 70/423; 70/150

[58] Field of Search ..... 70/278, 277, 276, 280, 70/283, DIG. 62, 467, 471, 473, 476, 478, 150, 475, 455, 423

[56] References Cited

U.S. PATENT DOCUMENTS

| | | | |
|---|---|---|---|
| 3,733,861 | 5/1973 | Lester | 70/278 |
| 4,326,125 | 4/1982 | Flies | 70/277 |
| 4,416,127 | 11/1983 | Gomez-Olea Naveda | 70/278 |
| 4,466,263 | 8/1984 | Rathmann | 70/277 |
| 4,712,398 | 12/1987 | Clarkson et al. | 70/276 |
| 4,807,454 | 2/1989 | Sengupta et al. | 70/DIG. 62 |
| 4,988,987 | 1/1991 | Barrett et al. | 70/63 |
| 5,057,830 | 10/1991 | Eisermann | 70/277 |
| 5,061,923 | 10/1991 | Miller et al. | 70/278 |
| 5,265,452 | 11/1993 | Dawson et al. | 292/142 |

FOREIGN PATENT DOCUMENTS

| | | | |
|---|---|---|---|
| 0283384 | 9/1988 | European Pat. Off. | 70/276 |
| 0329931 | 8/1989 | European Pat. Off. | 70/278 |
| 2589929 | 5/1987 | France | 70/283 |
| 2159568 | 12/1985 | United Kingdom | 70/278 |
| 2187227 | 9/1987 | United Kingdom | 70/276 |
| 92007156 | 4/1992 | WIPO | 70/278 |

*Primary Examiner*—Peter M. Cuomo
*Assistant Examiner*—Darnell M. Boucher
*Attorney, Agent, or Firm*—Eliot S. Gerber

[57] ABSTRACT

A lock system adapted to be used with both conventional mortise and cylinder locks includes an electronic socket to removably receive a button-like metal casing having an integrated circuit therein. The socket transmits code to a microprocessor based circuit which control a rotary two-directional motor. In one embodiment, the motor turns a cam which lifts, or lowers, a frame-like slide having a plunger which fits into a cavity of the cylinder to lock the cylinder.

12 Claims, 6 Drawing Sheets

RETROFITTABLE ELECTRONIC AND MECHANICAL DOOR LOCK SYSTEM

BACKGROUND OF THE INVENTION

1. Field of the Invention

The present invention relates to door lock systems using electronic and mechanical elements in which the keys are often changed, for example daily, and more particularly to such a system which may be retrofitted into a wide variety of existing mechanical door locks.

2. Discussion of Related Art

At the present time, the most widely used door lock system for houses uses a key having a pattern of grooves and an indented top surface. To unlock the door, the key is fitted into a keyhole and lifts small spring-loaded pins to enable a cylinder to be turned. The turning of the cylinder releases a latch and/or slides a bolt to unlock the door.

That type of lock, although relatively inexpensive, is subject to "picking", in which a thief, without a key, unlocks the door. In addition, that type of lock, when used in hotels, motels and other public facilities, may readily be opened by thieves or others whose entry in the rooms is not authorized, because the system will have a master key which will open a series of locks. However, the master key is as easily duplicated as any other key and there have been many instances of master keys falling into the hands of thieves and other unauthorized persons.

Because of its lack of security, simple key-operated locks are often not used in industry, offices and in hotels. Instead, they may use various types of electronic locks.

One type of electronic lock uses a numerical keypad which requires the entry of a number to release the lock. U.S. Pat. No. 4,148,092 shows this type of lock system. Such keypads are not used by hotels, since it is difficult to change their working numbers and the hotel guests may change daily.

A system widely used in hotels involves a card issued to the guest when he/she checks into the hotel. The card is inserted into an electronic card reader which reads the holes or magnetic strips or other magnetic patterns on the card. The door is unlocked if the pattern matches the number entered into the card reader for that day. This type of system is shown, for example, in U.S. Pat. Nos. 3,926,021; 4,717,816; 4,742,426; 4,802,353; 4,534,194; and 4,766,433.

One type of electronic lock system uses a central computer which communicates by wire to the lock mechanism at each door. A hotel office may have a special device which will punch cards or form magnetic areas on magnetic cards. The lock combination on the cards is in the form of digital bits and may be changed daily. The system is interactive because each time someone uses the system by opening an electronic lock, the entry is recorded in the log of the central computer and the operator may print-out a list of the persons who entered each room and the time they did so. This wired system, however, is expensive as it requires an expensive central computer, wiring of the system, and a relatively expensive machine to punch or magnetically mark the cards.

In an alternative system, each door has a radio transmitter which transmits the data information to a receiver connected to the central computer. However, it is subject to radio interference and is a relatively expensive system. A less expensive alternative is a non-interactive system. Each of the electronic door locks is independent and battery-operated. A machine at the central office, for example, the lobby desk of the hotel, will place the code on punch cards or magnetic cards, which is relatively expensive, since the machines to produce the code on such cards are costly. Each card is inserted into the card-reading mechanism which will read the punched holes or the magnetic marks. The first card insertion sets up the code within a lock. To open the lock, the user must again insert the card. Since the system is not interactive, there is no way, using the returned cards or other cards, to tell who has opened the lock or the time or date of any entries.

It has also been suggested that a "smart card" may be used in a security system. A smart card is a plastic card having an integrated circuit ("chip") embedded in it. The chip has a code which is read by the card reader. Such smart cards may present a problem in reliability because they use a series of contacts on an edge of the card, and those contacts may become dirty or worn.

It has also been suggested, in U.S. Pat. Nos. 4,297,569; 4,779,090; 4,326,125 and 4,712,398, that the chip may be embedded in a key, instead of a smart card. It is known to use an integrated circuit in a button casing for use in production and inventory control, for example, to track engines through a production line.

In U.S. Pat. No. 5,113,675 to Uyeda, the lock may be unlocked either by a conventional key or a card. A cam 72 operated a locking plate 60 having a tooth 64 which may be engaged in notch 75.

In U.S. Pat. No. 4,982,587 to Tzou, a conventional key operates pins which act on switches.

U.S. Pat. No. 4,703,163 to Genest shows an energy-saving circuit in a card reader type of electronic lock.

OBJECTS AND FEATURES OF THE INVENTION

It is an objective of the present invention to provide a universal electronic and mechanical lock system which will fit on, and may be retrofitted onto, American mortise locks, European mortise locks and American cylinder locks, and which does not use a solenoid, as a solenoid is relatively low in force and high in power consumption.

It is a further objective of the present invention to provide such a lock system which is battery operated, so it need not be wired to a power source, and which contains its own electronic operating system and memory, so it need not be wired to communicate with a computer system.

It is a further objective of the present invention to provide a security system which does not use a mechanical key and which uses an electronic key having only two contacts, to avoid contact and reading problems from multi-contacts on a card or a magnetic strip.

It is a still further objective of the present invention to provide such a lock system in which the door lock system may be used to reprogram the code on the electronic key, so that a separate computer system to reprogram keys or cards is not needed, and the system may be relatively inexpensive so that it may be used on home locks.

It is a further objective of the present invention that the electronic key may be programmed to be time limited, for example, its code would automatically expire in 24 hours, and the lock system on the door may keep an inventory of the times of entry and identity of each user, for example, to keep track of use by cleaning personnel in a hotel.

Further objectives of the present invention are to provide such a lock system in which the electronic keys are interactive with the key reader which controls the door lock, in that the key transmits data to the reader and receives data from the reader; to replace mechanical lock systems in which an easily duplicated master key may open numerous locks; to provide information, in the form of digital data, to special electronic keys, used, for example, by hotel personnel (information including which keys were used, when they were used, how often they were used, and the state of the batteries); to reduce lock maintenance, as both the electronic and mechanical portions are relatively reliable; to use a rugged electronic key to replace magnetic cards or punched cards which require specialized and relatively expensive code marking apparatus; to provide the same interactive information data from the door card readers, as in a wired or radio transmission system, but without the cost of a wired system or the cost and radio interference of a radio system.

BRIEF DESCRIPTION OF THE DRAWINGS other objectives and features of the present invention will be apparent from the following detailed description of the invention which should be considered in conjunction with the accompanying drawings.

DETAILED DESCRIPTION OF THE INVENTION

Figure 1:
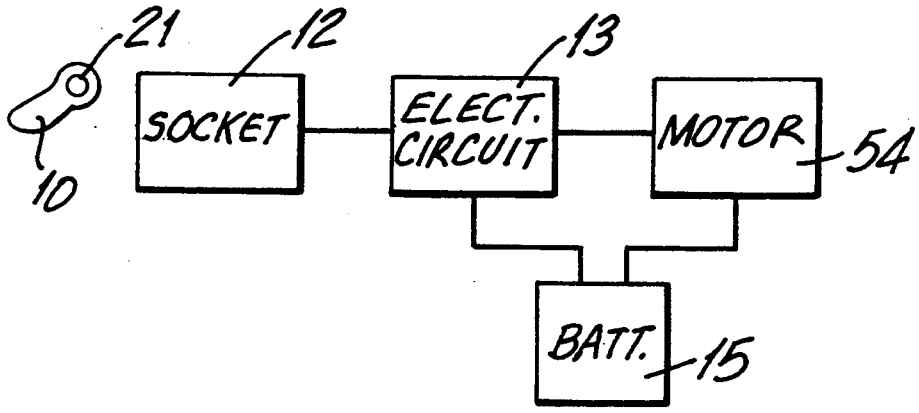
FIG. 1 is a block schematic diagram of the lock system of the present invention.
Figure 3:
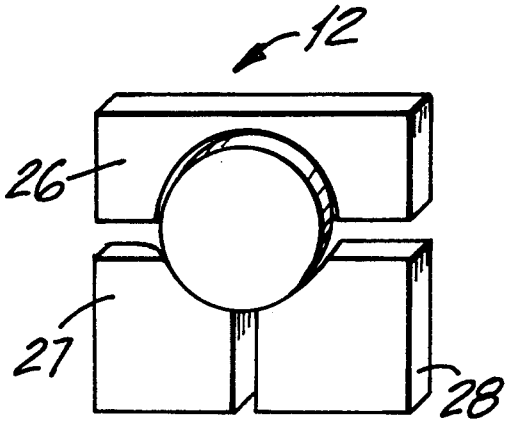
FIG. 3 is a perspective view of the key socket.

As shown in FIG. 1, the lock system of the present invention includes a touch key 10 having an electronic solid-state integrated circuit ("chip") encapsulated in a button-like container cell 21. The container is rugged as it is made of metal and preferably is the same type of container used for watch battery cells. The cell 21 removably fits into a socket (contact) 12 mounted on the door. A preferred socket design is shown in FIG. 3. The socket 12 has three electrical contacts which contact the cell 21 to receive digital data (code) from the cell and to transmit digital data to the chip of cell 21. The socket is in electrical contact with the electronic circuit 13 which is a printed circuit board having a microprocessor ("MPC"), such as Motorola 68705, INTEL 8052, INTEL 8031, or equivalent, on a printed circuit board. The circuit 13 controls DC motor 54. The motor 54 and circuit 13 are electrically connected to battery 15.

Figure 2:
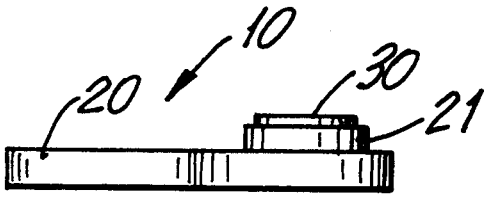
FIG. 2 is a side plan view of the touch key of the system.

As shown in FIG. 2, the touch key 10 includes a plastic holder 20 and a cell 21 mounted thereon. Cell 21 is a metal battery container having a diameter of about 0.5-inch and a height of about 0.23-inch. It contains a large-scale, solid-state integrated circuit having a RAM (Random Access Memory) of sufficient size, preferably 1000 bytes, to contain code and other information.

As shown in FIG. 3, the cell 21 removably fits in a socket 12. The socket 12 has a top contact 26 for ground (GND), a read and transmit contact 27 and a circuit awake contact 28.

Figure 4:
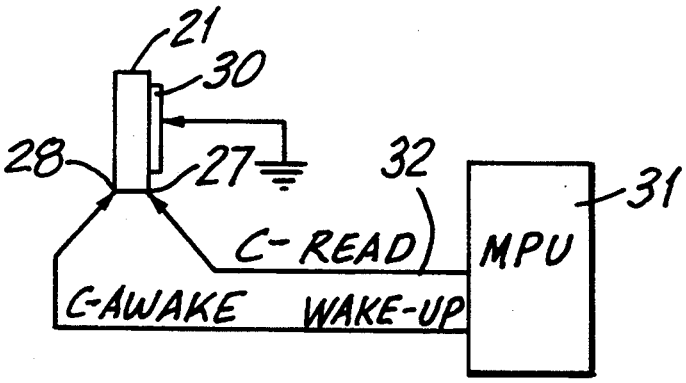
FIG. 4 is a schematic electrical diagram.

As shown in FIG. 4, a circuit to save battery power, the cover 30 of cell 21 is "ground" and is connected to ground by the ground contact 26 of socket 12. Upon insertion of the cell 21 into the socket a "wake-up" signal is communicated from cell 21 to the microprocessor (MPU) 31. This turns on the circuit and the reading, on line 32, is commenced. The presence of cell 21 at contact 28 is determined by a sense pulse from the microprocessor. The sense pulses are at a slow rate, for example, 10 Hz. When a circuit is closed by the presence of cell 21 at contact 28, the microprocessor is turned on at its normal rate, for example, a clock rate of 32K Hz. That clock rate is not used, to conserve power, until it is turned on.

Figure 6:
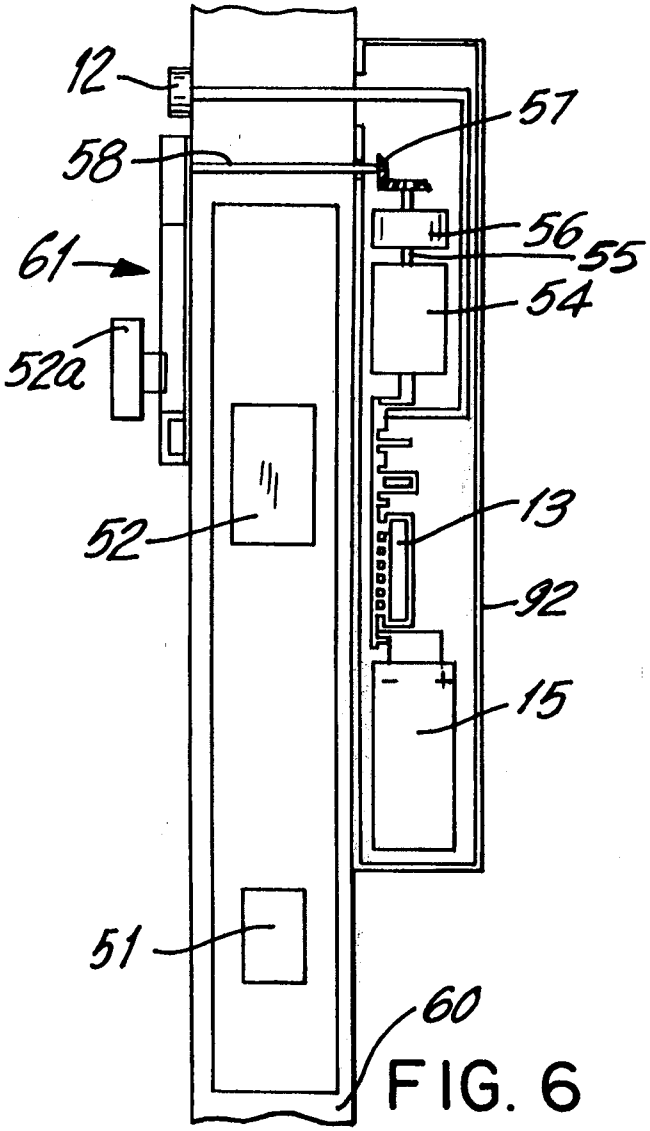
FIG. 6 is a side plan view of the lock mechanism.
Figure 5:
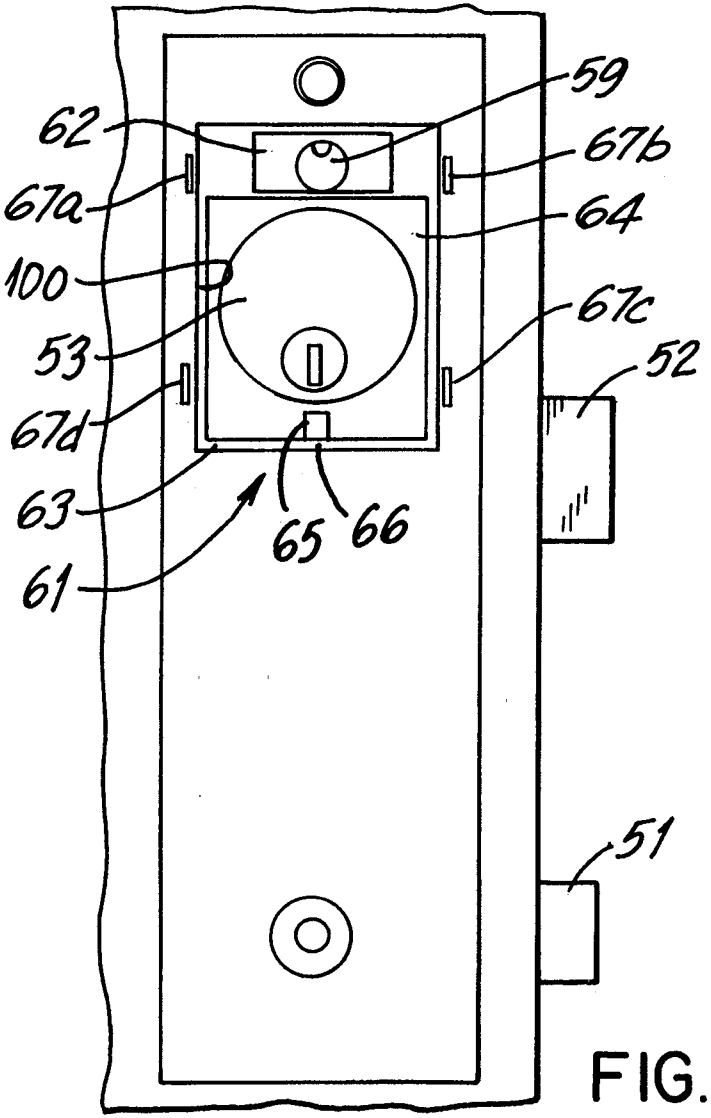
FIG. 5 is a front plan view of the lock mechanism.

As shown in FIGS. 5 and 6, the conventional mortise door lock mechanism includes a metal casing 50 and, within the casing, a spring-loaded latch, a dead bolt 52, a cylinder 53, and a turn buckle **52*a***.

The system of the present invention, in the embodiment of FIGS. 5 and 6, may be retrofitted to existing locks because none of its operating portions interfere with such installed locks. A typical cylindrical lockset is "Buy Line 2733" (TM, Russwin-Emhart, Berlin, Connecticut) and a typical mortise lockset is "9500 Series" (TM, Corbin-Emhart, Berlin, Conn.). The system includes a rotary DC motor 54 having an output shaft 55 and a reduction transmission gear system 56 fixed thereto. The output of gear system 56 is in mesh with teeth on the face of gear 57. The gear 57 is fixed to one end of the shaft 58 and a cam 59 is fixed on the opposite end of the shaft 58. The motor 54 and gear system 56 and gear 57 are mounted in a casing 92 on the inside face of the door 60.

The cylinder blocking mechanism 61 is on the outside face of the door. The cam 59 operates within the cam slot 62 to lift or lower the slide 63. The slide is a hollow frame having an interior space 64. The lock cylinder 53, which is conventional, is within the space 64. A plunger 65 (tooth) is fixed on the bottom 66 of the slide frame 63. The slide 63 is movable upwardly and downwardly within the fixed guides **67*a*–67*d* to place the plunger 65 in a slot 100** of the cylinder.

The battery 15 and circuit board 13 (including the MPU and drive circuit) are within a casing 92, which casing 92 also encloses the gear system 56 and gear 57.

In operation, to lock the door, the rotary motor 54 turns the gears of the reduction gear system 56 which rotates the gear 57 and cam 59. For example, the motor 54 may be programmed to rotate 200 times to turn the gear 57 (and cam 58) 180° (one-half turn).

Figure 8:
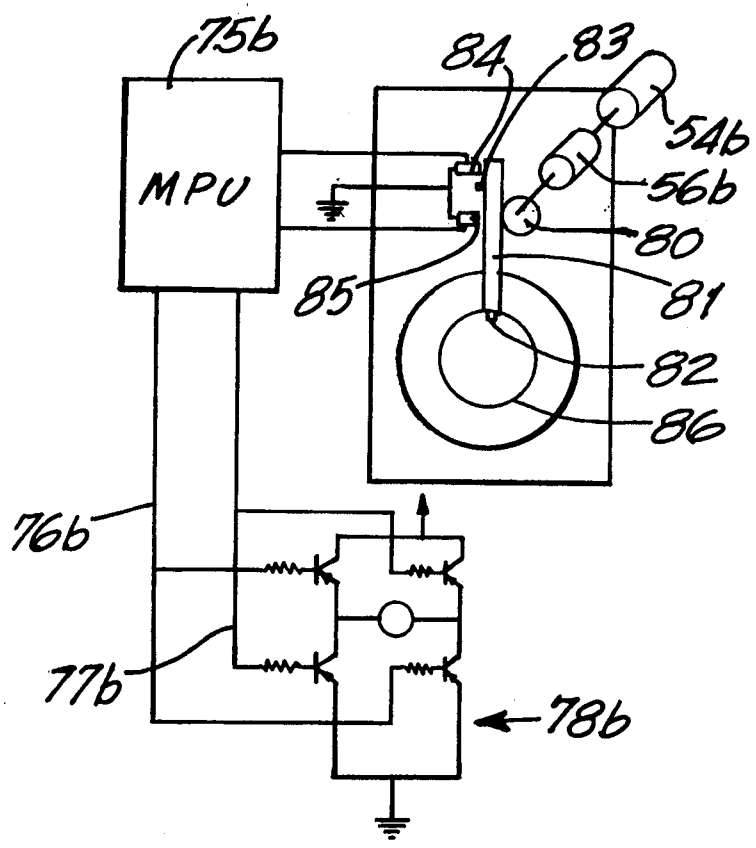
FIGS. 7 and 8 are diagrams of alternative embodiments.
Figure 7:
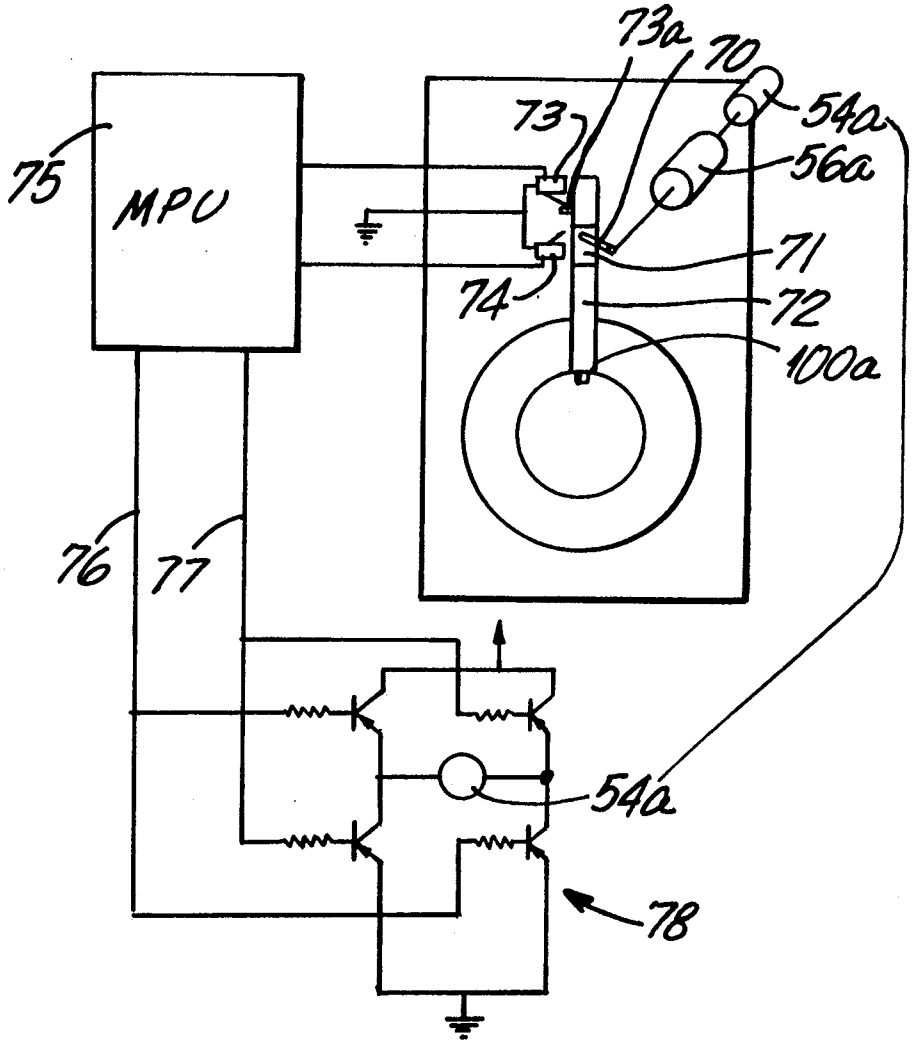

Alternative embodiments are shown in FIGS. 7 and 8. These embodiments are used with cylindrical locks and may be retrofitted to such locks. For details of this type of cylindrical lock, see U.S. Pat. No. 5,113,675, incorporated by reference, at FIG. 2. They operate with the same type of electronic button and socket shown in FIGS. 3 and 4. They use the same type of casing on the back of the door, battery power, and circuit board as shown in FIG. 6. In addition, they use the same type of reversible polarity DC rotary motor shown in FIG. 6. This type of motor has two leads (electrical connections), called herein "A" and "B". When plus power is applied to lead "A" and ground is applied to lead "B", the motor rotates its shaft in one direction (clockwise); but when plus power is applied to lead "B" and ground is applied to lead "A" the motor rotates its shaft in the opposite direction. When power is not applied to either lead, the motor does not rotate its shaft.

As shown in FIG. 7, an embodiment of a linked plunger mechanism, the motor 54*a* has an output shaft 55*a* which turns the first gear in a gear reduction system 56*a*. Preferably the reduction is in the range of 50:1 to 800:1 and most preferably is about 200:1. The gear reduction system is a series of large and small gears. The output shaft of the gear system 56*a* is connected to a pivotable arm 70 (link) whose free end is movable in slot 71 of vertically aligned shaft 72, which is slidable in a groove 100*a*.

A protruding pin 73*a* on shaft 72 is positioned to actuate microswitch 73 (when shaft 72 is raised) or microswitch 74 (when shaft 73 is lowered). The microswitches 73,74 are electrically connected to MPU 75 (CPU or microprocessor unit). The MPU 75 is electrically connected, by its two power output leads 76,77, to the motor polarity reversal circuit 78, which is on the circuit board 13.

Figure 11:
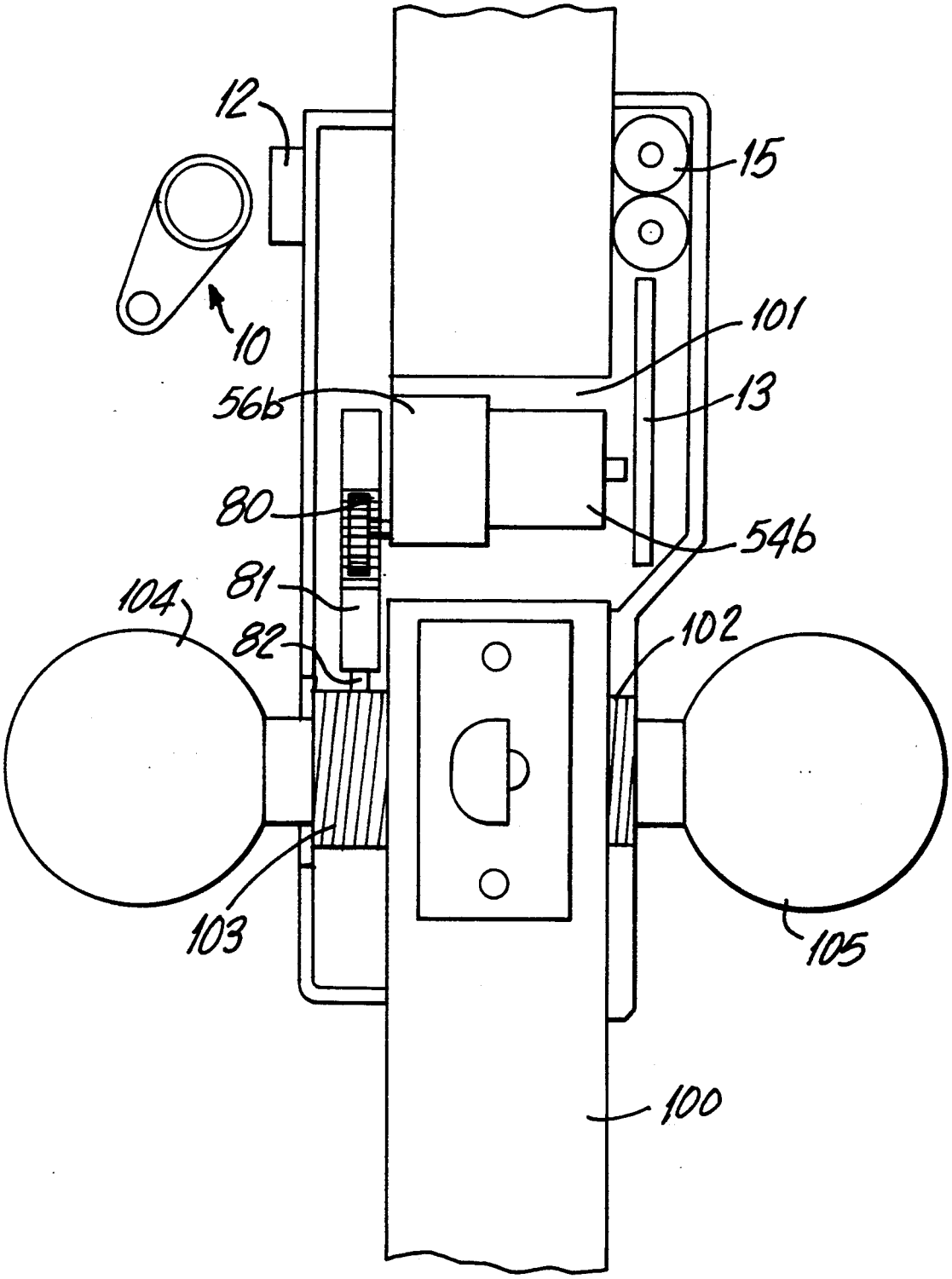
FIG. 11 is a side view, in cross-section, of the embodiment of FIG. 8.
Figure 12:
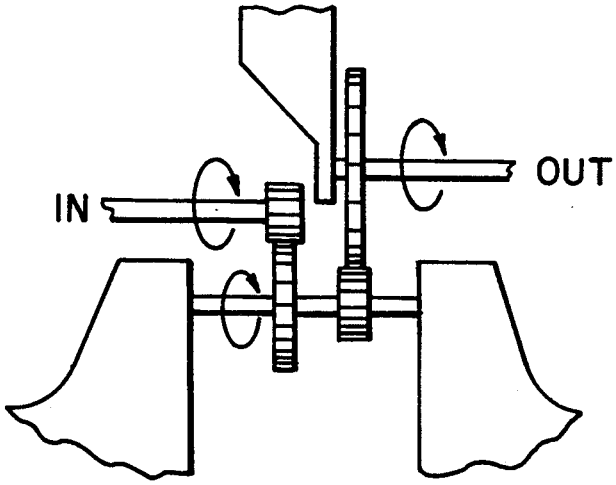
FIG. 12 shows a prior art gear reduction system.

In the embodiment shown in FIGS. 8 and 11, a rack-and-pinion lock mechanism is used to control the locking of a cylinder lock. The lock is mounted on door 100 having a hole 101 therethrough for the lock motor and having a hole 102 therethrough for the conventional cylinder 103, which may be turned by knob 104 (outside) or knob 105 (inside). The motor 54*b* has an output shaft which rotates the gears of a gear reduction system 56*b*, whose reduction ratio is preferably in the range or 50:1 to 800:1 and most preferably is about 200:1. The output shaft of the gear reduction system 56*b* is a pinion gear 80 which meshes with the teeth on elongated rack 81. The rack 81 (rack plunger) is vertically aligned and is slidable in a groove. Preferably the rack teeth have a pitch of 0.0666-inch. The rack 81, at its bottom, has a pin 82 which, when fitted into the slot of a lock cylinder 86 (turn shaft) of a cylindrical lock, will lock the cylinder (prevent its rotation). The rack 81 has a protruding pin 83 which operates microswitch 84 (when the rack is raised) and operates microswitch 85 (when the rack is lowered). The MPU-75*b*, output lines 76*b*, 77*b*, end motor polarity reversal circuit 78*b*, operate the same as the respective corresponding parts in the embodiment of FIG. 7.

A suitable gear reduction uses pinion gears each in mesh with a larger gear. The system uses a number of independently rotatable shafts each having fixed thereto a pinion gear and a larger gear. For example, the gear ratio, based on the circumferences of a pinion gear to a larger gear, is 1:3. When five such gear sets are used, the reduction is 3 to the fifth power or a ratio of 1:243.

It is an advantage of the present system, using a rotary motor and a gear reduction system, that the lock may be held in a locked or unlocked position without using power. In a solenoid system, to keep the door unlocked requires the solenoid to be activated. If the door is to be unlocked for an extended period, for example, during 8 hours each day on a program held in MPU memory, the solenoid would drain the battery. In the present system the door may be held unlocked, for example, on a programmed basis, without a drain of power. Once the door is locked, or unlocked, it stays in that status without a drain of power, until activated to change its status.

The system of the present invention allows for the collection of data, for example, as to who enters each room, the time and date, as well as a limit on the time and room each electronic key is programmed to enter.

Figure 9:
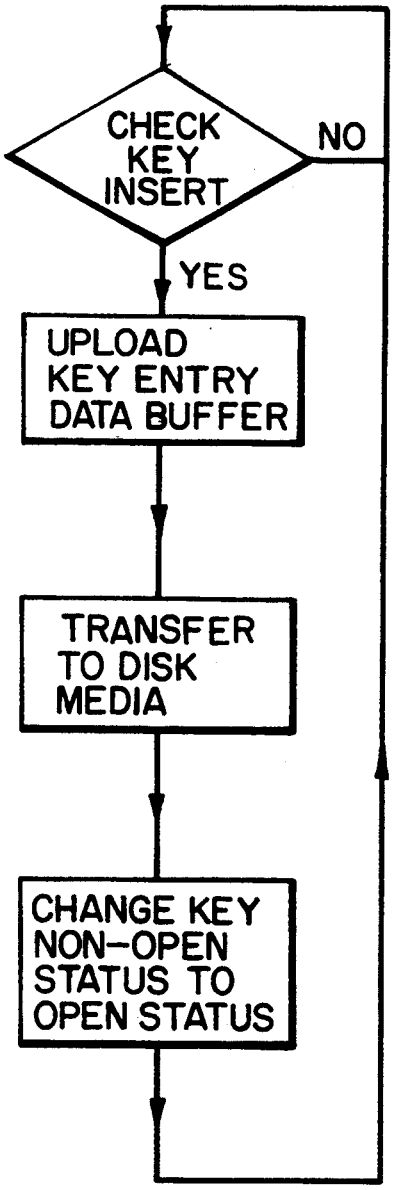
FIGS. 9 and 10 are software program outlines.

FIG. 9 shows the outline of a suitable software program for the entry data collection computer.

Figure 10:
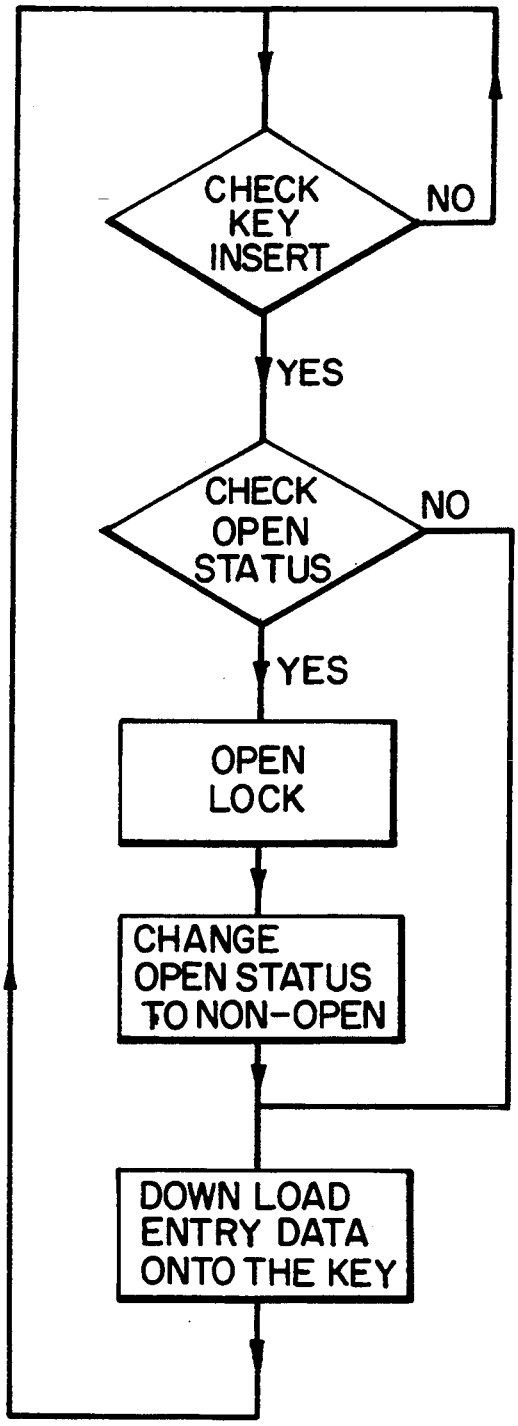

A suitable maid or service key operation is shown, in a software outline, in FIG. 10. For example, a maid or service person will insert his/her electronic key into a room electronic lock female socket. Data, which has been collected in the electronic memory of the electronic lock, for example, in the RAM of the MPU, is transferred to the electronic key and stored in its memory. The program of FIG. 10 is resident in each of the locks of the system.

The maid/service person will then insert the electronic key in the socket of the entry data collection computer, see FIG. 9. That computer may be an IBM-AT or compatible therewith. It will download the data in the electronic key and load new data therein, for example, so that the electronic key may be used the next day to open the locks at a selected group of rooms.

Modifications may be made in the above-described embodiments within the scope of the sub-joined claims. For example, an integrated circuit on the circuit board and the integrated circuit of the electronic key may be an EEPROM (electrically erasable programmable read-only memory). The batteries 15 may be three alkaline 1.5 volt size AA cells. In the event of a power failure, a special key is used, having its own battery, which applies power to the lock system. The frame of FIGS. 5 and 6 may be used with the rack-and-pinion of FIG. 8 or the link of FIG. 9. For example, a rack may be mounted on the frame and in mesh with a pinion 80, as in FIG. 8.

I claim:

1. A lock system adapted to be fitted onto conventional locks having a cylinder which turns to unlock a door, the cylinder having a slot therein, the lock system comprising portions of a device installable on a door;

(a) an electronic socket adapted to read digital code from a portable electronic key means inserted therein;

(b) an electronic circuit means to verify the code with code stored therein and produce a control signal upon the verification of the code the electronic circuit including a programmable microprocessor and being connected to the socket;

(c) a rotary bi-directional direct current motor controlled by the electronic circuit means and having an output shaft;

(d) a gear reduction system having a series of meshing gears and driven by the motor output shaft, the reduction system having a reduction ratio of at least 50:1 and having a rotatable output gear;

(e) a transfer means driven by the reduction system output gear;

(f) a battery connected to the motor and electronic circuit;

(g) a slide means mounted for vertical sliding motion and slidable by the transfer means;

(h) a projection fixed to the slide means and when the slide means is moved by the transfer means the projection is inserted into the slot of the cylinder thereby preventing the cylinder from turning and locking the door and when the slide means is again moved by the transfer means the projection is removed from the slot and thereby unlocks the door.

2. A lock system as in claim 1 wherein the transfer means is a pinion gear and the slide means is an elongated rack in mesh with the pinion gear.

3. A lock system as in claim 1 wherein the transfer means is a pivotable link having a free end thereon and the slide means is a shaft enclosing said free end.

4. A lock system as in claim 1 wherein the electronic key means comprises an electronic integrated circuit encased in a button-like cylindrical metal casing.

5. A lock system as in claim 1 wherein the motor has a horizontally aligned motor output shaft and a first gear of the gear reduction system is fixed to the motor output shaft.

6. A lock system as in claim 4 wherein the integrated circuit has erasable digital code memory means to store a changeable digital code and to store additional digital data.

7. A lock system as in claim 6 wherein the integrated circuit is an EEPROM (electrically erasable programmable read-only memory).

8. A lock system as in claim 1 wherein at least one of the electronic key means is an emergency key including a battery.

9. A lock system as in claim 1 and including a casing adapted to be fastened on the inside of a door, wherein the battery, the circuit means and the motor are within the casing.

10. A lock system as in claim 1 wherein the microprocessor reads the digital code of the electronic key means upon insertion of the electronic key means into said socket and transmits digital data to the electronic key means.

11. A lock system as in claim 1 wherein the slide means comprises a frame forming a space enclosing a portion of the cylinder and having a bottom cross-piece and the projection is fixed to the frame on the bottom cross-piece thereof.

12. A lock system as in claim 11 wherein the motor has a vertically aligned output shaft, a first gear of the gear reduction system is fixed to the motor output shaft, the transfer means includes a horizontally aligned shaft and a cam fixed to the horizontally aligned shaft, wherein the cam is in contact with the frame to slide the frame.

* * * * *